United States Patent [19]

Ray et al.

[11] 4,347,076

[45] Aug. 31, 1982

[54] ALUMINUM-TRANSITION METAL ALLOYS MADE USING RAPIDLY SOLIDIFIED POWERS AND METHOD

[75] Inventors: Ranjan Ray, Waltham, Mass.; Donald E. Polk, Washington, D.C.; Bill C. Giessen, Cambridge, Mass.

[73] Assignee: Marko Materials, Inc., North Billerica, Mass.

[21] Appl. No.: 193,417

[22] Filed: Oct. 3, 1980

[51] Int. Cl.[3] ..... C22C 1/04

[52] U.S. Cl. ..... 75/0.5 R; 75/138; 75/139; 75/144; 75/213; 75/249; 148/11.5 A; 148/11.5 P; 148/32

[58] Field of Search ..... 75/138, 0.5 R, 139, 75/144, 213, 214, 226, 249; 148/11.5 A, 11.5 P, 32

[56] References Cited

U.S. PATENT DOCUMENTS 3,625,677 12/1971 Jones ..... 75/138

*Primary Examiner*—R. Dean

*Attorney, Agent, or Firm*—Morse, Altman, Oates & Dacey

[57] ABSTRACT

A method of fabricating aluminum alloys containing finely dispersed aluminum-transition metal intermetallic phases is disclosed. The alloys are subjected to melt spinning to form a brittle filament consisting in large measure of a metastable face-centered cubic solid solution; this is then pulverized to a staple or powder configuration; the power or staple is consolidated using conventional techniques. Upon heat treatment, the solid solution decomposes into a structure consisting of an aluminum alloy matrix of conventional composition containing a fine uniform dispersion of the intermetallic phase, the heat-treated alloy being ductile. The heat-treated alloys possess high strength, especially at elevated temperatures. Preferred alloys are disclosed which contain 10 to 15 wt % Fe.

19 Claims, No Drawings

ALUMINUM-TRANSITION METAL ALLOYS MADE USING RAPIDLY SOLIDIFIED POWERS AND METHOD

BACKGROUND OF THE INVENTION

1. Field of the Invention

This invention relates to a method of producing staple or powders of certain aluminum alloys which contain transition metals using rapid solidification processing and to their subsequent consolidation and heat treatment to have desirable mechanical properties. The invention also relates to preferred Al-Fe compositions made by this method.

2. Description of the Prior Art

Rapid solidification processing (RSP) techniques offer outstanding prospects for the creation of new, cost-effective engineering materials which may have physical properties superior to those otherwise available (see Proceedings, Int. Conf. on Rapid Solidification Processing; Reston, Va., 1977; Claitor's Publishing Division, Baton Rouge). Depending on alloy composition, RSP techniques can be used to alter the structure and microstructure of the alloys compared to that achieved by ordinary production processes; the high cooling rates typical of high volume RSP processes ($\sim 10^5$–$10^7$ °C./sec) can produce metastable phases and prevent or markedly reduce the compositional segregation and can occur during slower solidification.

In particular, RSP can be used to produce metastable extended solid solutions wherein a large excess of a solute element can be retained uniformly throughout the host element or alloy. Upon suitable heat treatment, a fine dispersion of particles of the equilibrium intermetallic phase within the host matrix can be produced. The potential for using this approach to produce unusual dispersion-hardened aluminum alloys having desirable mechanical properties has long been recognized (see the review of T. R. Anantharaman et al, Trans. Ind. Inst. of Metals; Vol 30, December 1977, pp. 423–448).

A wide variety of RSP techniques amenable to commercial utilization are known. One sub-category of these is known as melt spin chill casting (for examples see S. Kavesh, pp. 165–187, Proceedings, Int. Conf. on Rapid Solidification Processing, 1977, and U.S. Pat. No. 4,142,571, Narasimhan) which is especially attractive since it produces a ribbon or sheet (both herein defined as a ribbon) at a high production rate and at low cost: further, the product is uniform in that all parts of the product experience a relatively uniform cooling rate.

It is recognized by those skilled in the art that a wide variety of related RSP techniques can be used to produce ribbons or sheets from the melt.

The generic term "melt spin chill casting" is used here in its most general sense to include all RSP techniques in which the molten metal is brought into contact with a rapidly moving solid substrate of high thermal conductivity so as to form a ribbon or sheet having an average thickness of about 25 to 100 microns, the ribbon or sheet having been subjected to a cooling rate of about $10^5$ to $10^7$ °C./sec. Thus, the term melt spin chill casting is used to include processes such as "melt extraction" and two substrate techniques such as "twin-roll quenching" (see H. A. Davies in Rapidly Quenched Metals III, Vol. 1, The Metals Society, London, 1978, pp. 1–21).

Since RSP powders would be highly useful to ease subsequent consolidation, several approaches to making such a product have been developed. Generally, atomization of the liquid is utilized, followed by various cooling procedures. A limitation of such RSP powder processes is that a range of liquid droplet sizes is produced and the droplets of different sizes then experience a range of cooling rates, leading to a non-uniform product. Further, the larger droplets may experience low cooling rates which do not produce the desired effect. Screening so as to use only the finest particles leads to a lowered yield and a less economic process. One process which has been extensively studied for aluminum is impinging the liquid droplets formed by atomization onto a solid quench surface. However, non-uniformity was observed in as-quenched alloy made in this manner (see I. G. Palmer, R. E. Lewis and D. D. Crooks in Proceedings, Second Int. Conf. on Rapid Solidification Processing, 1980) as well as in the microstructures of alloys made by consolidating such material (see T. H. Sanders, J. W. Johnson and E. E. Underwood in Proceedings, Second Int. Conf. on Rapid Solidification Processing, 1980).

While a wide variety of elements are potentially useful to produce dispersion hardening in RSP aluminum alloys, in particular the common transition metal elements, iron is an especially attractive additive in part because of its low cost. The Al-Fe system has been extensively studied; in particular, an alloy containing 8 wt% Fe has been shown to have an ultimate tensile fracture strength of approximately 33,000 psi at 350° C. (see C. M. Adam & R. G. Bourdeau in Proceedings, Second Int. Conf. on Rapid Solidification Processing, 1980), significantly higher than that exhibited by conventional aluminum alloys at this temperature.

It appears that there is the need for a method to produce RSP powders of aluminum containing high levels of transition metals which are more uniform than those now available. Further, the inclusion of larger amounts of the transition metals than can now be done without deleterious effects in combination with the improved uniformity can lead to the achieving of properties, in particular high tensile fracture strength at elevated temperatures, better than that which have so far been achieved.

SUMMARY OF THE INVENTION

This invention features a novel method of fabricating aluminum alloy powders and their subsequent consolidation and heat treatment to have a homogeneous microstructure containing a uniform dispersion of intermetallic phases containing aluminum and at least one transition metal. The transition metal content is selected such that the aluminum-transition metal intermetallic phase occupies approximately 10 to 32 volume % of the alloy, preferably 20 to 30 volume %. This is achieved by including between 5 and 16 wt% of the transition elements Fe, Cr, Ni, Co, Mn, V, Ti, Zr, Mo, and W, and B in the alloy, with the restriction that the total content of Mn, V, Ti, Zr, Mo, and W, singly or combined, not exceed 5 wt% and the boron content not exceed 1 wt%. Further, preferred alloys are provided which contain 10 to 15 wt% Fe. The transition metals may be added to nominally pure aluminum or to a conventional aluminum alloy.

In the above method, the modified aluminum alloys are subjected to rapid solidification processing (RSP) by using a melt spin chill casting method wherein the liquid alloy is cooled at rates of approximately $10^5$ to $10^7$ °C./sec while being formed into a solid ribbon or sheet. The transition metal elements listed above and B have only very slight solubility in aluminum; however, upon rapid solidification processing, they are retained in large measure in a metastable solid solution based on the aluminum face-centered cubic structure. This as-quenched metastable alloy is very brittle and is readily comminuted to a staple or powder form using standard pulverization techniques, e.g. a rotating hammer mill. Upon heat treatment at temperatures greater than about 300° C., the metastable solid solution phase decomposes into a ductile product consisting of an aluminum matrix of more conventional composition which contains a fine dispersion of intermetallic phases based on aluminum and transition metals, e.g., depending on the alloy composition, $Al_3Fe$, $Al_3Ni$, $Al_9Co_2$ and $Al_7Cr$. These finely dispersed intermetallic phases strengthen the matrix and enhance the microstructural stability and strength at elevated temperatures. The powder or staple is consolidated into bulk shapes using conventional methods, for example extrusion or cold pressing and sintering. The heat treatment to precipitate the intermetallic phases can be done prior to, during, or subsequent to the consolidation. When the alloy also contains more conventional alloying elements, e.g. Cu, Mg, etc., the matrix is further strengthened upon suitable heat treatment by the formation of conventional age hardening precipitates.

This invention also features the alloys made according to the foregoing methods.

DETAILED DESCRIPTION OF THE PREFERRED EMBODIMENTS

In accordance with the present invention, nominally pure aluminum or a conventional aluminum alloy which contain at least 80 wt% aluminum, commercial aluminum alloy or a developmental Al-Li alloy, is further alloyed with one or more of the transition metals Fe, Cr, Ni, Co, Mn, Ti, V, Zr, Mo and W, and B, the transition elements and boron comprising between 5 and 16 wt% of the alloy, wherein the total amount of the elements, Mn, V, Ti, Zr, Mo and W present singly or combined does not exceed 5 wt% and boron does not exceed 1 wt%. The above alloys are rapidly solidified using any of the various RSP techniques generically labelled as melt spin chill casting which produce cooling rates of the order of $\sim 10^5$ to $10^7$ °C./sec and which produce a ribbon-like (or sheet-like) final product. The ribbons so produced consist predominately of a metastable face-centered cubic solid solution phase, are very brittle, and have a high degree of compositional uniformity. The brittle ribbons are readily pulverized to a staple or powder configuration using standard comminution techniques. The powder or staple is consolidated using standard techniques. For purposes of difinition, the term powder is considered to include both powder and staple. Heat treatment of the as-quenched alloy can be used to precipitate a fine dispersion of aluminum-transition metal intermetallic compounds within a more conventional aluminum-rich matrix, such material being ductile and having unusually high tensile fracture strength at about 350° C. as compared to commercial aluminum-rich alloys.

The alloying elements, Tm, where TM is one or more of Fe, Cr, Ni, Co, Mn, Ti, V, Zr, Mo, W and B, all have very limited equilibrium solubility in elemental aluminum. When Al-Tm alloys containing 5 to 16wt% TM are solidified using conventional slow casting processes, one obtains a microstructure containing large grains of the intermetallic phase and hence large scale compositional segregation and undesirable mechanical properties. However, rapid solidification processing of these alloys produces primarily a metastable solid solution phase. At TM contents in the upper part of the 5 to 16 wt% range, fine precipitates of the intermetallic phase also appear, but the overall compositional uniformity is greatly enhanced compared to conventionally cast alloys. As-quenched alloys of this composition are, in general, quite brittle, allowing the ready comminution of melt spun ribbons to a staple or powder configuration. At least approximately 5 wt% of TM is needed for the as-quenched alloys to be sufficiently brittle to allow ready pulverization; conventional aluminum alloys, when melt spun, are ductile. Above approximately 16 wt% TM, as discussed below, the final consolidated, heat-treated alloy has less desirable physical properties.

When the above as-solidified alloys are appropriately heat treated (typically at 300 to 500° C. for 1 to 10 hours), the solid solution phase decomposes into the equilibrium phases, typically the more aluminum-rich fcc phase and the most Al-rich Al-TM intermetallic phase. Depending on composition, this can be the $FeAl_3$ phase, or $CrAl_7$, $MoAl_{12}$, etc. This heat treatment can be a separate annealing treatment or can occur coincident with the consolidation step. As a result of this heat treatment and hot working during a hot consolidation operation, the intermetallic phase of phases form as ultrafine precipitates. The precipitates typically have a characteristic size less than $\sim 0.5$ micron, preferably less than 0.05 micron; these precipitates are dispersed in a matrix of nominally pure aluminum or a conventional aluminum alloy composition, having a grain size less than $\sim 10$ micron, preferably less than 3 micron. For the compositions of the present invention, i.e. 5 to 16 wt% TM, the aluminum-TM phase will occupy approximately 10 to 32 volume % of the alloy. For the preferred composition range of approximately 10 to 15 wt% TM, in particular 10 to 15 wt% Fe (about 5 to 7.5 at% Fe), the Al-TM phase will occupy approximately 20 to 30 volume %. Since different TM additions can lead to different Al-TM compounds, the amount of precipitate that is formed for a given weight % of TM will depend on the stoichiometry of the compound which forms and the atomic weight of the TM elements which are present. Below 5 wt% TM, there is too little of the Al-TM phase to produce the significantly enhanced properties; above 16 wt% TM, the heat treated alloy tends to be brittle because too much of the Al-TM phase is present. Within the range of 5 to 16 wt% TM, heat treatment can be used to produce a ductile alloy with useful properties, in particular, high strength at elevated temperatures.

The addition of the TM elements to the Al at the levels of the present invention increases the liquidus temperature of the alloys. For ease of handling during the melt spinning process, it is desirable to use alloys having liquidus temperatures below $\sim 1{,}000$° C. Thus, Ti and Zr are limited to under 5 wt% in order to keep the liquidus temperature within this range; W, Mo, and V are included in the under 5 wt% limitation to keep the liquidus temperature low and because, when they dominate, they form compounds, e.g. $MoAl_{12}$, which produce a much greater volume % of precipitate for a given atomic percent additive.

The initial melt spun ribbon or sheet is typically 25 to 75 microns thick. The rapidly solidified materials of the above described compositions are sufficiently brittle so that they can be readily mechanically comminuted by standard known equipment such as a ball mill, hammer mill, pulverizer, fluid energy mill, or the like. Depending on the degree of pulverization to which the ribbons are subjected, one obtains different particle sizes. Partial pulverization can be used to produce a staple wherein at least one dimension is much greater than the initial thickness, e.g. of the order of 1 cm. Preferably, a smaller particle size is produced such that the ribbon or sheet is converted into a powder, e.g. a −100 mesh powder. Either the powder or staple can be consolidated into fully dense bulk parts by various known techniques such as hot isostatic pressing, hot rolling, hot extrusion, hot forging, cold pressing followed by sintering, etc.

While any of a wide variety of RSP processes are known in the art, the combination of melt spinning and subsequent pulverization is preferred for these alloys. The quench rate experienced by the liquid is much more uniform in the melt spinning proces than, e.g., in atomization techniques. In atomization techniques, the quench rate (and hence the metastable structure and the final, heat treated structure derived therefrom) varies greatly with particle size. Screening out the larger particles formed from atomization gives material which has been subjected to a more uniform quench, but the yield is then reduced, making the process less economical. In powders or staple made from pulverized ribbons, particles of all sizes have experienced essentially the same quench history and hence the consolidated product will be highly uniform. The melt-spinning-pulverization procedure can be practiced so as to have a high yield (e.g., >95%) of a relatively fine powder (e.g., −100 mesh).

The microstructure obtained after consolidation will depend upon the composition of the alloy and the consolidation conditions. Excessive times at high temperatures can cause the fine precipitates to coarsen beyond the optimal submicron size and can lead to a deterioration of the properties, i.e. a decrease in hardness and strength.

After consolidation, additonal heat treatments similar to those used for the same purpose for commercial precipitation hardening aluminum alloys can be used to harden the matrix in which the particles of the aluminum-transition metal phase(s) are dispersed when the matrix contains traditional precipitation hardening elements, e.g. Cu and Mg. These hardening treatments cause the precipitation, within the aluminum-rich matrix, of conventional precipitation hardening intermetallic phases, the identity of which depends on alloy composition, as occurs in the heat treatment of standard aluminum alloys.

The physical properties of the heat treated alloy depend on which intermetallic phase forms the precipitates as well as on the relative amount of the precipitates. Thus, a specific property can be optimized by identifying those alloying elements and the degree of alloying which optimize that property. Of particular interest for the dispersion hardened alloys of this invention is tensile strength at elevated temperature, e.g. 350° C. The tensile strengths of commercial aluminum alloys fall rapidly as the temperature increases. However, the Al-TM compounds remain stable to higher temperatures and hence lead to low density alloys having relatively high strengths at the elevated temperature. It has been found that alloys containing iron, having compositions within the range described below, have exceptionally high tensile fracture strengths (>40,000 psi) at 300° to 350° C.

The alloys in the binary Al-Fe system with the Fe content between 10 and 15 wt% prepared in accordance with the present invention belong to a preferred group of alloys. These alloys are described by the formula $Al_{bal.}Fe_{10-15}$. Examples include $Al_{90}Fe_{10}$ and $Al_{87}Fe_{13}$. (Subscripts are in wt% and must therefore add to 100). These alloys, upon rapid quenching by melt spinning, form extremely brittle ribbon consisting predominantly of a single f.c.c. solid solution phase. The quenched alloys may additionally contain some fine scale decomposition phases dispersed in the matrix. Upon heat treatment between 400° and 500° C. for 1 to 3 hours the solid solution phases decomposes giving rise to a fine scale dispersion of the intermetallic phase $Al_3Fe$ which then comprises of the order of 25 volume % of the alloy. After such heat treatment, such Al-Fe alloys become ductile and possess micro-hardness values between 150 and 250 kg/mm$^2$.

Another preferred class of alloys is obtained by adding up to 4 wt% Cu to the above binary Al-Fe alloys, this class being defined by the general formula $(Al_{bal.}Fe_{10-15})_{bal.}Cu_{0-4}$. Examples include $Al_{86.02}Cu_{1.51}Fe_{12.47}$, $Al_{87.89}Cu_{2.21}Fe_{10.8}$ and $Al_{87.36}Cu_{0.45}Fe_{12.19}$.

By suitable heat treatment, the as-cast brittle ribbons of the alloys of the above class can be rendered ductile and hard with typical hardness values ranging between 150 and 250 kg/mm$^2$. The microstructure consists of an ultrafine dispersion of the intermetallic phase, $Al_3Fe$, as well as $Al_2Cu$ in a fine-grained matrix.

Another preferred class of alloys is obtained by replacing up to 4 wt% of the Fe in the above Al-Fe alloy with one or more of the elements TM=Cr, Ni, Co, Mn, Mo, W, V, Ti, Zr, and B, given by the formula $Al_{bal.}Fe_{(10-15)-X}(TM)_X$ where X is less than or equal to 4 and the B content does not exceed 1 wt%.

Typical examples include $Al_{bal.}Cr_{1.35}Fe_{13}$, $Al_{bal.}Cr_3Fe_{10}$, $Al_{bal.}Mo_2Fe_{11.5}$, and $Al_{bal.}Co_2Fe_{10.5}$.

The above described Al-Fe alloys of the present invention exhibit high room temperature tensile strength and, more significantly, high elevated temperature (350° C.) tensile strength. One of the ways to achieve elevated temperature strength is to form a fine dispersion of thermodynamically stable precipitated particles. The presence of Fe in conventionally cast Al alloys normally has a deleterious effect on properties because of the relatively coarse intermetallic particles that are formed; rapid solidification processing of such alloys according to the present invention results in a very fine dispersion of stable intermetallic phases based on Al-Fe leading to excellent elevated temperature strength.

For the above alloys, the dominant mechanism of strengthening both at room and elevated temperature is dispersion hardening. To achieve the most effective dispersion hardening, the precipitate size must be very small and the precipitate distribution must be uniform.

Commercial 7075 aluminum alloys or variations of it fabricated from air or inert gas atomised powder or splat quenched particulate are known to have tensile strength values approaching 100 KSI (see for reference J. P. H. A. Durand, R. M. Pelloux and N. J. Grant, Materials Science and Engineering, page 247, 1976; W. S. Cebulak, E. W. Johnson, and M. Markus, Met. Eng. Quart., page 37, 1976). However, because these alloys are strengthened primarily by a coherent precipitation hardening mechanism, overaging (i.e. coarsening of the precipitate particles) begins at temperatures above about 120° C., thereby causing a large decrease in strength. At 150° C. (high strength) commercial aluminum alloys of the 7000 series exhibit maximum tensile strength values up to ~30 KSI (see Metal Progress Databook, Mid-June 1979, page 80). In contrast, the Al-Fe base alloys processed in accordance with the present invention typically have, at 150° C., tensile strengths of at least 60 to 66 KSI, much higher than the commercial 7000-series aluminum alloys.

Furthermore, the present aluminum alloys typically exhibit at 300° C. tensile strength values of at least 40 KSI. In comparison, aluminum alloys containing 6–8 wt% Fe with various additions of Cr, Mn, and Mg up to 2.75 wt% prepared from powder made using a splat casting process of Battelle-Frankfurt (see G. Faninger, D. Merz and H. Winter, 2nd International Conference on Rapidly Quenched Metals, page 483, edited by N. J. Grant and B. C. Giessen, M. I. T. Press, Cambridge, 1976) exhibited tensile strengths of only between 20 and 30 KSI at this temperature.

The maximum tensile strengths yet reported for aluminum alloys at 350° C. (32 and 33 KSI) were exhibited by aluminum alloys containing 8 wt% Fe with about 2 wt% of various other elements, e.g. Si+Mo, and processed from rapidly solidified powder, (see C. M. Adam & R. G. Bourdeau in Proceedings Second Int. Conf. on Rapid Solidification Processing, Reston, Va., 1980).

The present invention is explained in more detail by means of the following examples.

EXAMPLES 1–9

Aluminum base alloys containing between 5 and 16 wt% of the transition metals, Fe, Ni, and Co were prepared by melting the constituent elements (see Table 1 for compositions). These alloys were melt spun, i.e. a molten jet of each alloy was directed onto a rotating cylinder made of a precipitation hardened copper beryllium alloy. The as-cast ribbons, typically 25–75 microns thick, were found to be brittle to bending. The degree of brittleness of melt-spun ribbons can be readily characterized by a simple bend test wherein the metallic ribbon can be bent to form a loop and the diameter of the loop gradually reduced until the ribbon either fractures or bends back onto itself. For those ribbons that fracture, the breaking diameter of the loop is a measure of the degree of brittleness; the smaller the breaking diameter for a given ribbon thickness, the less brittle the ribbon is considered to be. A ribbon which bends back onto itself without breaking has deformed plastically into a "V" shape and is labelled fully ductile.

The as-quenched ribbons of the alloys in Table 1 were all found to be quite brittle and had breaking diameters of 0.1" or more. These brittle ribbons were ground to a −100 mesh powder using a commercial rotating hammer mill. The as-quenched ribbons were found by x-ray diffraction analysis to consist in large part of a metastable f.c.c. solid solution phase, based on aluminum.

Other as-quenched ribbons of these compositions were heat treated at 400° C. for 1½ hours and were found to become fully ductile. The microhardnesses of the heat treated ribbons ranged between 80 and 200 Kg/mm².

TABLE 1

Composition and hardness values of aluminum base alloys containing transition metals Fe, Ni, and Co as prepared in accordance with the present invention by melt spinning; the hardness is measured after being heat treated at 400° C. for 1½ hours and air cooled.

| Example | Alloy Composition | Hardness (kg/mm²) |
|---|---|---|
| 1 | $Al_{bal.}Ni_{14}$ | 89 |
| 2 | $Al_{bal.}Fe_{13.47}$ | 201 |
| 3 | $Al_{bal.}Co_{10.31}$ | 125 |
| 4 | $Al_{bal.}Fe_{10.74}$ | 127 |
| 5 | $Al_{bal.}Fe_{3.87}Ni_{8.14}$ | 81 |
| 6 | $Al_{bal.}Fe_{12.57}$ | 191 |
| 7 | $Al_{bal.}Ni_{10}$ | 83 |
| 8 | $Al_{bal.}Fe_{7.5}$ | 85 |
| 9 | $Al_{bal.}Fe_{4.3}Ni_{3.5}Co_{1.5}$ | 112 |

EXAMPLES 10–16

Standard aluminum base alloys, e.g. 2024 ($Al_{bal.}Cu_{4.4}Mn_{0.6}Mg_{1.5}$), 7075 ($Al_{bal.}Mg_{2.5}Zn_{5.6}Cr_{0.23}Cu_{1.6}$) and 2024 containing 2% lithium, were additionally alloyed with nickel and iron between 10 and 15 wt%. These alloys (see Table 2 for compositions) were melt spun into rapidly solidified ribbons. The ribbons were found to be brittle to bending and could be readily pulverized using the rotating hammer mill. Other as-quenched ribbon samples of these compositions, upon heat treatment at 400° C. for 1½ hours, became fully ductile and had hardness values between 100 and 175 kg/mm².

TABLE 2

Composition and hardness values of ribbions of standard aluminum alloys modified to contain iron and nickel prepared in accordance with the present invention by melt spinning process; hardness is measured after being heat treated at 400° C. for 1½ hours and air cooled.

| Example | Alloy Composition (wt %) | Hardness (kg/mm²) |
|---|---|---|
| 10 | Commercial 2024 alloy + 10 wt % Fe | 166 |
| 11 | Commercial 2024 alloy + 2 wt % Li and 15 wt % Ni | 108 |
| 12 | Commercial 2024 alloy + 2 wt % Li and 12 wt % Fe | 180 |
| 13 | Commercial 7075 alloy + 10 wt % Ni | 105 |
| 14 | Commercial 7075 alloy + 10 wt % Fe | 164 |
| 15 | Commercial 7075 alloy + 12 wt % Fe | 175 |
| 16 | Commercial 7075 alloy + 14 wt % Ni | 126 |

EXAMPLES 17–26

A number of ternary aluminum base alloys in the Al-Fe-Cu systems were prepared as RSP ribbon in accordance with the present invention. The melt spun ribbons were found to be sufficiently brittle to permit ready pulverization. Upon heat treatment at 400° C. for 1½ hours, the melt spun ribbons became fully ductile and had hardness values between 170 and 235 kg/mm². Table 3 lists the alloy compositions and hardness values of the heat treated ribbons.

TABLE 3

Composition and hardness values of Al rich Al—Fe—Cu alloys prepared in accordance with the present invention by melt spinning; hardness is measured after being heat treated at 400° C. for 1½ hours and air cooled.

| Example | Alloy Composition (wt %) | Hardness (kg/mm²) |
|---|---|---|
| 17 | $Al_{bal.}Fe_{12.19}Cu_{0.45}$ | 188 |

TABLE 3-continued

Composition and hardness values of Al rich Al—Fe—Cu alloys prepared in accordance with the present invention by melt spinning; hardness is measured after being heat treated at 400° C. for 1½ hours and air cooled.

| Example | Alloy Composition (wt %) | Hardness (kg/mm²) |
|---|---|---|
| 18 | $Al_{bal.}Fe_{10.65}Cu_{1.53}$ | 170 |
| 19 | $Al_{bal.}Fe_{10.8}Cu_{2.2}$ | 185 |
| 20 | $Al_{bal.}Fe_{11.17}Cu_{2.2}$ | 197 |
| 21 | $Al_{bal.}Fe_{10.90}Cu_{3.26}$ | 172 |
| 22 | $Al_{bal.}Fe_{13.38}Cu_{1.30}$ | 210 |
| 23 | $Al_{bal.}Fe_{12.92}Cu_{1.51}$ | 200 |
| 24 | $Al_{bal.}Fe_{13.42}Cu_{0.86}$ | 237 |
| 25 | $Al_{bal.}Fe_{12.95}Cu_{1.1}$ | 220 |
| 26 | $Al_{bal.}Fe_{12.47}Cu_{1.51}$ | 187 |

EXAMPLES 27–38

In accordance with the present invention, the following alloys were melt spun to a brittle ribbon suitable for ready comminution, said alloys becoming ductile after being heat treated at 400° C. for 1½ hours.

TABLE 4

Compositions of Al-rich alloys containing transition metals prepared in accordance with the present invention as melt-spun brittle ribbons.

| | Composition (wt %) |
|---|---|
| 27. | $Al_{bal}V_5$ |
| 28. | $Al_{bal}Mo_4Fe_1$ |
| 29. | $Al_{bal}W_4Fe_1$ |
| 30. | $Al_{bal}Fe_7V_3$ |
| 31. | $Al_{bal}Fe_8W_2$ |
| 32. | $Al_{bal}Fe_7Ti_3$ |
| 33. | $Al_{bal}Fe_8Zr_3B_{0.5}$ |
| 34. | $Al_{bal}Zr_3Ti_2$ |
| 35. | $Al_{bal}Fe_8Mn_3$ |
| 36. | $Al_{bal}Ni_{10}W_1Mo_1Ti_1Zr_1V_1$ |
| 37. | $Al_{bal}Fe_5Ni_3W_{0.5}Mo_2Cr_3$ |
| 38. | $Al_{bal}Cr_3V_3Ti_1Zr_{0.5}W_{0.5}$ |

EXAMPLES 39–40

In accordance with the present invention, two aluminum base alloys in Al-Cu-Ni and Al-Cu-Ni-B system (see Table 5) were prepared by melt spinning as brittle ribbons suitable for comminution. Upon heat treatment at 475° C. for 1.5 hours followed by air cooling to room temperature the ribbons were found to show additional age hardening behavior upon subsequent low temperature annealing treatment. Hardness values of the ribbons age given in Table 4.

TABLE 5

Composition and hardness values of Al rich Al—Ni—Cu and Al—Ni—Cu—B alloys prepared as RSP ribbons by melt spinning and after being heat treated.

| Example | Alloy Composition (wt %) | (Stage 1) As cast ribbon heat treated at 475° C. for ½ hrs. followed by air cooling Hardness (kg/mm²) | (Stage 2) The ribbons after stage 2 were heat treated at 175° C. for 2 hrs. Hardness (kg/mm²) |
|---|---|---|---|
| 39 | $Al_{bal.}Cu_4Ni_{15}$ | 110 | 146 |
| 40 | $Al_{bal.}Cu_4Ni_{15}B_{0.7}$ | 90 | 133 |

EXAMPLES 41–48

A number of aluminum alloys containing one or more of the transition metals Fe, Ni, Co, Ti, Mo, W and Cr were prepared as RSP ribbon according to the present invention. The melt spun ribbons were found to be brittle. Upon heat treatment at 400° C. for 1½ hours, the melt spun ribbons became ductile and had hardness values between 105 and 200 kg/mm².

Table 6 lists the alloy compositions and hardness values of the heat treated ribbons.

TABLE 6

Composition and hardness values of Al rich alloys containing transition metals prepared according to the present invention by melt spinning and after being heat treated at 400° C. for 1½ hours and air cooled.

| Example | Alloy Composition | Hardness (kg/mm²) |
|---|---|---|
| 41 | $Al_{bal.}Cr_{9.2}$ | 139 |
| 42 | $Al_{bal.}Fe_3Cr_1Ni_5Mo_{0.5}W_{0.2}Ti_{0.3}$ | 106 |
| 43 | $Al_{90}Fe_4Ni_3Co_2Cr_1$ | 128 |
| 44 | $Al_{bal.}Cr_{1.33}Fe_{13.0}$ | 236 |
| 45 | $Al_{bal.}Cr_{1.35}Fe_{11.59}$ | 213 |
| 46 | $Al_{bal.}Cr_{5.5}$ | 176 |
| 47 | $Al_{bal.}Cr_{4.5}$ | 186 |
| 48 | $Al_{bal.}Cr_3Fe_{10}$ | 198 |

EXAMPLE 49

A commercial aluminum 2024 alloy was modified to contain 10 wt% iron. The alloy was melt spun into a ribbon shape. The ribbons which were found to be brittle were pulverized by a commercial Bantam Mikro Pulverizer into powder. The powder was screened through a 100 mesh (U.S. Standard) sieve and gave a high yield of the under 100 mesh powder.

EXAMPLE 50

Using the method described above, two pounds of RSP powder (−100 mesh) of each of the two aluminum alloys $Al_{bal.}Cu_{1.3}Fe_{12.5}$ and $Al_{bal.}Cr_{1.35}Fe_{11.59}$ (subscripts in wt%) were made.

The powders were put in an aluminum can, heated at 200° C. for 2 hours while being evacuated under vacuum and sealed off. The can was heated to 400° C. and extruded at 25:1 ratio resulting into 100% consolidation of the powders into a rod. Mechanical properties of the consolidated rod at room temperature and elevated temperature are given in Table 7.

TABLE 7

Tensile properties of Al—Cr—Fe Alloys in extruded forms made in accordance with the present invention.

| | Tensile Strength (KSI) | | | |
|---|---|---|---|---|
| Alloy Composition (wt %) | Room Temp. | 150 C. | 300 C. | 350 C. |
| $Al_{bal.}Cu_{1.3}Fe_{12.5}$ | 74 | 58 | 40 | 34 |
| $Al_{bal.}Cr_{1.35}Fe_{11.59}$ | 76 | 66 | 54 | 50 |

EXAMPLE 51

The following example illustrates excellent thermal stability of aluminum alloys containing large amounts of fine dispersion of stable intermetallic phase based on Al-Fe prepared in accordance with the present invention. Two aluminum alloys, $Al_{bal.}Cu_{1.3}Fe_{12.5}$ and $Al_{bal.}Cr_{1.35}Fe_{11.59}$ prepared from RSP powders as extruded rod in accordance with procedures described in example 50 and exhibited room temperature hardness of 175 and 213 kg/mm². After heat treatment of the above two alloys at 350° C. for 100 hours, there was no change in hardness values observed.

EXAMPLE 52

The following example illustrates an economical method of continuous production of RSP powder of the aluminum or aluminum base alloy containing one or more of the elements Fe, Ni, Co, Cr, Mn, V, Mo, W, Ti, Zr, and B in accordance with the present invention.

The commercial aluminum base alloys containing 5 to 16 wt% of the transition metals within the scope of the invention are melted by vacuum induction melting. The melt is transferred via a ladle into a tundish having a series of orifices. A multiple number of jets are allowed to impinge on a rotating water-cooled copper-beryllium drum whereby the melt is rapidly solidified as ribbon. The as-cast brittle ribbons are fed into a hammer mill whereby the ribbons are ground into powders of desirable size ranges. The entire operation as described above is carried out under high vacuum or a protective atmosphere to limit oxidation.

While the invention has been described with particular reference to the preferred embodiments, numerous modifications thereto will appear to those skilled in the art.

Having thus described the invention, what we claim and desire to obtain by Letters Patent of the United States is:

1. The method of making an alloy comprised of at least one of the group consisting of nominally pure aluminum and conventional aluminum alloys containing at least 80 wt% aluminum wherein said one of the group is further alloyed with between 5 to 16 wt% of a transition metal selected from the group consisting of iron, nickel, cobalt, manganese, vanadium, chromium, molybdenum, tungsten, titanium, zirconium, boron, and mixtures thereof wherein said manganese, vanadium, molybdenum, tungsten, titanium and zirconium, when present, are at a combined level up to 5 wt% and boron, when present, at a level up to 1 wt%, comprising the steps of (a) forming a melt of said alloy, (b) contacting said melt against a rapidly moving quench surface adapted to quench said melt at a rate in the range of approximately $10^{5°}$ to $10^{7°}$ C./second and form thereby a rapidly solidified brittle ribbon of said alloy characterized by a metastable structure, and, (c) comminuting said ribbon into fragments so as to form a powder thereof.

2. The method of claim 1 wherein said transition metal is iron present at a level in the range between 10 and 15 wt%.

3. The method of claim 2 wherein said alloy is further alloyed with up to 4 wt% copper.

4. The method of claim 2 wherein up to 4 wt% of said iron is substituted by at least one of the group consisting of nickel, chromium, cobalt, manganese, molybdenum, tungsten, vanadium, titanium, zirconium and boron and said boron is present at a level of up to 1 wt%.

5. The method of claim 1 wherein the quench rate is at least $10^{6°}$ C./sec.

6. The method of claim 1 wherein said ribbon is comminuted into powder having an average particle size of less than 4 mesh (U.S. Standard) comprising platelets having an average thickness of less than 0.1 mm and each platelet being characterized by an irregular shape resulting from fracture of the solidified material.

7. The method of claim 1 including the step of forming said fragements into a consolidated body by the application thereto of pressure.

8. The method of claim 1 including the step of forming said fragments into a consolidated body by the application thereto of pressure and heat.

9. The method of claim 7 wherein the consolidated body is heated to a temperature in the range of 300° to 500° C. for a time sufficient to transform the metastable structure of said alloy to a fine grained microstructure with primary grains having an average grain size of less than about 10 microns with substantially uniform dispersion of ultrafine precipitates of intermetallic phases formed between aluminum and one or more of said transition metals, said ultrafine precipitates having a characteristic size of less than about 0.5 micron.

10. The method of claim 7 wherein said microstructure contains intermetallic phase precipitates having an average size of less than 0.05 microns.

11. The method of claim 7 wherein said consolidated body has a thickness of at least 1 mm measured in the shortest dimension.

12. An alloy, comprised of (a) at least one of the group consisting of nominally pure aluminum and conventional aluminum alloys containing at least 80 wt% aluminum, wherein said one of the group is further alloyed with between 8 to 16 wt% of at least one of the transition metals from the group consisting of iron, nickel, cobalt, chromium, manganese, vanadium, molybdenum, tungsten, titanium and zirconium and boron, wherein the maximum of vanadium, molybdenum, tungsten, titanium and zirconium in total is 5 wt% and the maximum amount of boron is 1 wt%, (b) said alloy being in powder form produced by rapid solidification of the melt of said alloy to produce a ribbon having predominately a metastable solid solution phase with a face-centered cubic structure and hardness values between 200 and 450 $Kg/mm^2$, which is comminuted into powder said powder having an average particle size of less than 4 mesh (U.S. Standard), the particles being platelets having an average thickness of less than 0.1 mm.

13. The alloy of claim 12 having the composition represented by the formula $Al_{85-90}Fe_{10-15}$ wherein the subscripts define weight percent of said powder is characterized by a hardness between 300 and 450 $kg/mm^2$.

14. The alloy of claim 13 wherein up to 4 wt% of said iron is replaced by at least one of the elements from the group consisting of nickel, chromium, cobalt, manganese, molybdenum, tungsten, vanadium, titanium, zirconium and boron, wherein said boron is present up to 1 wt%.

15. The alloy of claim 13 including up to 4 wt% copper.

16. An alloy represented by the formula $Al_{85-90}Fe_{10-15}$ wherein the subscripts represent weight percent, said alloy being formed from the consolidation of particles of said alloy produced from a comminuted solid body thereof resulting from a melt of said alloy being subjected to cooling rates of about $10^{5°}$ to $10^{7°}$ C./sec., said alloy having an ultrafine dispersion of the intermetallic phase $FeAl_3$ and having a thickness of at least 1 mm in the shortest dimension and an average tensile strength of at least 40,000 psi at 300° C.

17. An alloy according to claim 16 wherein up to 4 wt% of said iron is replaced by at least one of the group consisting of chromium, nickel, cobalt, manganese, tungsten, molybdenum, titanium, vanadium, zirconum and boron and where boron, when present, is at a level up to 1 wt%.

18. An alloy according to claim 16 wherein the aluminum content thereof is replaced by a conventional aluminum alloy containing at least 80 wt% aluminum.

19. An alloy according to claim 17 wherein the aluminum content thereof includes a conventional aluminum alloy containing at least 80 wt% aluminum.

* * * * *

Notice of Adverse Decision in Interference

In Interference No. 101,419, involving Patent No. 4,347,076, R. Ray, D. E. Polk and B. C. Giessen, ALUMINUM-TRANSITION METAL ALLOYS MADE USING RAPIDLY SOLIDIFIED POWERS AND METHOD, final judgment adverse to the patentees was rendered Jan. 15, 1986, as to claims 1–19.

[*Official Gazette April 8, 1986.*]